US012723360B2

(12) United States Patent
Sheng et al.

(10) Patent No.: US 12,723,360 B2
(45) Date of Patent: Sep. 1, 2026

(54) RIPARIAN ZONE OF RESERVOIR

(71) Applicants: CHINA POWER CONSTRUCTION EAST CHINA SURVEY, DESIGN AND RESEARCH INSTITUTE (ZHENGZHOU) CO. LTD., Zhengzhou (CN); POWERCHINA HUADONG ENGINEERING CORPORATION LIMITED, Hangzhou (CN)

(72) Inventors: Sheng Sheng, Zhengzhou (CN); Junwei Jia, Zhengzhou (CN); Guowang Zhou, Zhengzhou (CN); Yongfa Guan, Zhengzhou (CN); Cong Zhu, Zhengzhou (CN)

(73) Assignees: CHINA POWER CONSTRUCTION EAST CHINA SURVEY, DESIGN AND RESEARCH INSTITUTE (ZHENGZHOU) CO., LTD., Zhengzhou (CN); POWERCHINA HUADONG ENGINEERING CORPORATION LIMITED, Hangzhou (CN)

( * ) Notice: Subject to any disclaimer, the term of this patent is extended or adjusted under 35 U.S.C. 154(b) by 65 days.

(21) Appl. No.: 18/882,030

(22) Filed: Sep. 11, 2024

(65) Prior Publication Data

US 2025/0003164 A1 Jan. 2, 2025

Related U.S. Application Data

(63) Continuation of application No. PCT/CN2023/081632, filed on Mar. 15, 2023.

(30) Foreign Application Priority Data

Mar. 17, 2022 (CN) ..... 202210265031.4

(51) Int. Cl.
*E02B 3/04* (2006.01)

(52) U.S. Cl.
CPC ..... *E02B 3/04* (2013.01)

(58) Field of Classification Search
CPC ..... E02B 3/00; E02B 3/04; E02B 3/10; E02B 3/12
See application file for complete search history.

(56) References Cited

U.S. PATENT DOCUMENTS

2014/0042064 A1* 2/2014 Byeon ..... C02F 3/046 210/170.01
2018/0348013 A1* 12/2018 Farahmand ..... G01F 9/00

FOREIGN PATENT DOCUMENTS

DE 3705425 C1 * 8/1988 ..... E02B 3/04

* cited by examiner

*Primary Examiner* — Kyle Armstrong
(74) *Attorney, Agent, or Firm* — JC ONE WORLD

(57) ABSTRACT

The present invention relates to a riparian zone of a reservoir, which zone is arranged on a side slope of a river, lake or reservoir. The riparian zone has a low-frequency submergence area, a relatively-low-frequency submergence area, a medium-frequency submergence area, a relatively-high-frequency submergence area and a high-frequency submergence area, which are sequentially arranged on a side slope of a reservoir from top to bottom and are distributed according to a cumulative submergence frequency of the side slope of the reservoir; a submerged bank structure is arranged in the relatively-high-frequency submergence area, and vegetation of the relatively-high-frequency submergence area is planted on the submerged bank structure of the relatively-high-frequency submergence area; vegetation of the medium-frequency submergence area is planted in the medium-frequency submergence area; and vegetation of the relatively-low-frequency submergence area is planted in the relatively-low-frequency submergence area.

15 Claims, 2 Drawing Sheets

RIPARIAN ZONE OF RESERVOIR

CROSS-REFERENCE TO RELATED APPLICATION

This application is a bypass continuation of International Application No.: PCT/CN2023/081632 filed on Mar. 15, 2023, which claims the benefit of Chinese Patent Application No.: CN202210265031.4, filed Mar. 17, 2022, the entire contents of which are incorporated by reference in their entirety.

FIELD

The present invention relates to the field of ecological restoration engineering, specifically to a reservoir drawdown zone (a riparian zone of a reservoir).

BACKGROUND

The drawdown zone is a unique phenomenon in rivers, lakes, and reservoirs, which refers to the area where reservoirs experience seasonal water level fluctuations and periodic water storage between the highest and lowest water levels. The drawdown zone is a transitional zone controlled alternately by aquatic and terrestrial ecosystems. It is the last ecological barrier for surrounding sediment, organic matter, fertilizers, pesticides, and other substances to enter the water body, as well as a buffer zone for water circulation regulation. It has various ecological and environmental service functions in improving the productivity of aquatic and terrestrial ecosystems and maintaining the dynamic balance of regional ecosystems.

Due to the periodic fluctuations of water levels around the water area, the reservoir drawdown zone has dual attributes of water and land, and is controlled by the water gradient for a long time. It is a special seasonal wetland ecosystem that plays an important role in maintaining the dynamic balance of water and land ecosystems, biodiversity, ecological security, and ecological service functions. Vegetation is an important component of the reservoir drawdown zone and the main body of its functions. Therefore, strengthening the research on plants in the reservoir drawdown zone is of great significance for the management and ecological restoration of the reservoir drawdown zone.

Poor utilization of the drawdown zone can lead to serious ecological and environmental problems, mainly including:

(1) Soil erosion, decreased stability of bank slopes, and in severe cases, natural disasters such as landslides, collapses and mudslides may occur;

(2) the drop of water level triggers the leaching of pollutants from the soil, pollutes water bodies, and also changes soil quality, affects the physical, chemical and biological properties of the soil;

(3) simplify the structure and function of ecosystems and damage biodiversity.

SUMMARY

The technical problem to be solved by the present invention is to provide an effective, widely applicable and feasible reservoir drawdown zone for ecological restoration in response to the above-mentioned problems.

The Technical Solution Adopted by the Present Invention is

A reservoir drawdown zone is arranged on the slope of a river, lake or reservoir, and according to historical water level data, the area of the slope of the reservoir is divided, which has a low-frequency submergence area, a relatively-low-frequency submergence area, a medium-frequency submergence area, a relatively-high-frequency submergence area, and a high-frequency submergence area arranged in sequence from top to bottom on a slope of the reservoir according to a cumulative submergence frequency distribution of the slope of the reservoir; a submerged bank structure is arranged in the relatively-high-frequency submergence area, and relatively-high-frequency submergence area vegetation is arranged in the relatively-high-frequency submergence area on the submerged bank structure; a medium-frequency submergence area vegetation is arranged in the medium-frequency submergence area; and a relatively-low-frequency submergence area vegetation is arranged in the relatively-low-frequency submergence area.

Furthermore, the low-frequency submergence area refers to the area where a cumulative submergence frequency of the slope of the reservoir is between 0% and 20%, the relatively-low-frequency submergence area refers to the area where a cumulative submergence frequency of the slope of the reservoir is between 20% and 40%, the medium-frequency submergence area refers to the area where a cumulative submergence frequency of the slope of the reservoir is between 40% and 60%, the relatively-high-frequency submergence area refers to the area where a cumulative submergence frequency of the slope of the reservoir is between 60% and 80%, and the high-frequency submergence area refers to the area where a cumulative submergence frequency of the slope of the reservoir is between 80% and 100%.

Furthermore, a low-lying channel is arranged on a downstream slope of the submerged bank.

Furthermore, a slope ratio of the upstream slope of the submerged bank is 1:3-1:4, and the slope ratio of the downstream slope of the submerged bank is 1:2-1:3.

Furthermore, the slope surface of the upstream slope of the submerged bank is provided with alternating convex structures and concave structures, wherein soil fixing plants are planted on the convex structures and submerged plants are planted inside the concave structures.

Furthermore, the submerged bank has a second submerged bank and a first submerged bank arranged from top to bottom in the high-frequency submerged area, and a submerged bank foot protection is provided at the bottom of the upstream slope of a first submerged bank.

Furthermore, Bermuda grass and *Potamogeton malaianus* are alternatively planted in divided areas on a first submerged bank, *Potamogeton malaianus* and *Calamus* are alternatively planted in divided areas on a second submerged bank.

Furthermore, the medium-frequency submergence area vegetation planted in the medium-frequency submergence area includes Zhongshan fir, Bermuda grass and *Calamus*, which are planted throughout the medium-frequency submergence area.

Furthermore, the relatively-low-frequency submergence area vegetation planted in the relatively-low-frequency submergence area includes Paper mulberry, *Pterocarya stenoptera*, Bermuda grass, *calamus* and vetiver grass, wherein the Bermuda grass, *calamus* and vetiver grass are planted throughout the relatively-low-frequency submergence area.

Furthermore, several ponds are excavated in the relatively-low-frequency submergence area.

Furthermore, water retaining walls higher than the relatively-low-frequency submergence area are provided around the pond, and electric control gates are installed on the water retaining walls, an outer side of the electric control gates is equipped with a first water level sensor, and an inner side of the electric control gates is equipped with a second water level sensor.

The low-frequency submergence area refers to the area where a cumulative submergence frequency of the slope of the reservoir is 0% to 20%, the relatively-low-frequency submergence area refers to the area where a cumulative submergence frequency of the slope of the reservoir is 20% to 40%, the medium-frequency submergence area refers to the area where a cumulative submergence frequency of the slope of the reservoir is 40% to 60%, the relatively-high-frequency submergence area refers to the area where a cumulative submergence frequency of the slope of the reservoir is 60% to 80%, and the high-frequency submergence area refers to the area where a cumulative submergence frequency of the slope of the reservoir is 80% to 100%.

The advantageous effects of the present invention include:

(1) A reservoir drawdown zone according to an embodiment of the present invention forms a water level frequency curve and a water level frequency accumulation curve based on historical data of the reservoir water level. The reservoir drawdown zone is divided into regions according to the water level frequency accumulation curve, and targeted planting is carried out based on the characteristics of water level frequency and plant growth characteristics in different regions to maximize the soil fixation and water purification capacity of the reservoir drawdown zone. This targeted planting can enable plants to adapt to non-natural water level drawdown situations in the reservoir and meet the water level needs of the reservoir. Specifically, planting aquatic plants with amphibious growth characteristics, the vegetation has the ability to quickly and lush regress and recover growth after emerging from the water surface; at the same time, vegetation has developed root systems, which have good soil stabilization (soil-fixing) and protection effects, and can prevent and control soil erosion in the drawdown zone.

(2) The embodiment of the present invention provides a reservoir drawdown zone by constructing a submerged bank and foot protection below the drawdown zone. On the one hand, it plays a protective role, preventing water flow erosion and providing a safe growth environment for aquatic plants; on the other hand, local low-lying areas have formed between the submerged banks, accumulating water resources. When the water level is low, it can still provide a certain amount of water supply for aquatic vegetation in the drawdown zone.

BRIEF DESCRIPTION OF DRAWINGS

In order to provide a clearer explanation of the embodiments of the present invention or the technical solutions in the prior art, the following will briefly introduce the accompanying drawings required for the description of the embodiments or prior art. It is clear that the accompanying drawings described below are only exemplary. For skilled person in the art, other implementation drawings can be derived from the provided drawings without creative labor.

The structure, proportion, size, etc. shown in this specification are only for the purpose of cooperating with the content disclosed in the specification, for the understanding and reading of those familiar with this technology, and are not intended to limit the conditions under which the present invention can be implemented. Therefore, any modification of the structure, change in proportion relationship, or adjustment of size should still fall within the scope of the technical content disclosed in the present invention without affecting the efficacy and objectives that can be achieved by the present invention.

In the figures.

1. Reservoir water level frequency curve; 2. Cumulative frequency curve of reservoir water level; 3. Elevation range of the restoration area of the drawdown zone; 4. high-frequency submergence area; 5. relatively-high-frequency submergence area; 6. medium-frequency submergence area; 7. relatively-low-frequency submergence area; 8. low-frequency submergence area; 9. Submerged bank foot protection; 10. Upstream Slope; 11. Downstream slope; 12. Low-lying channel; 13. Convex structure; 14. concave structure; 15. Pond; 16. Water retaining wall; 17. Gate; 18. First water level sensor; 19. Second water level sensor; 20. Block.

DETAILED DESCRIPTION

The following specific embodiments illustrate the embodiments of the present invention. Those familiar with this technology can easily understand the other advantages and effects of the present invention from the content disclosed in this specification. Obviously, the described embodiments are a part of the embodiments of the present invention, not all of them. Based on the embodiments of the present invention, all other embodiments obtained by ordinary skilled persons in the art without creative labor are within the scope of protection of the present invention.

Figure 1:
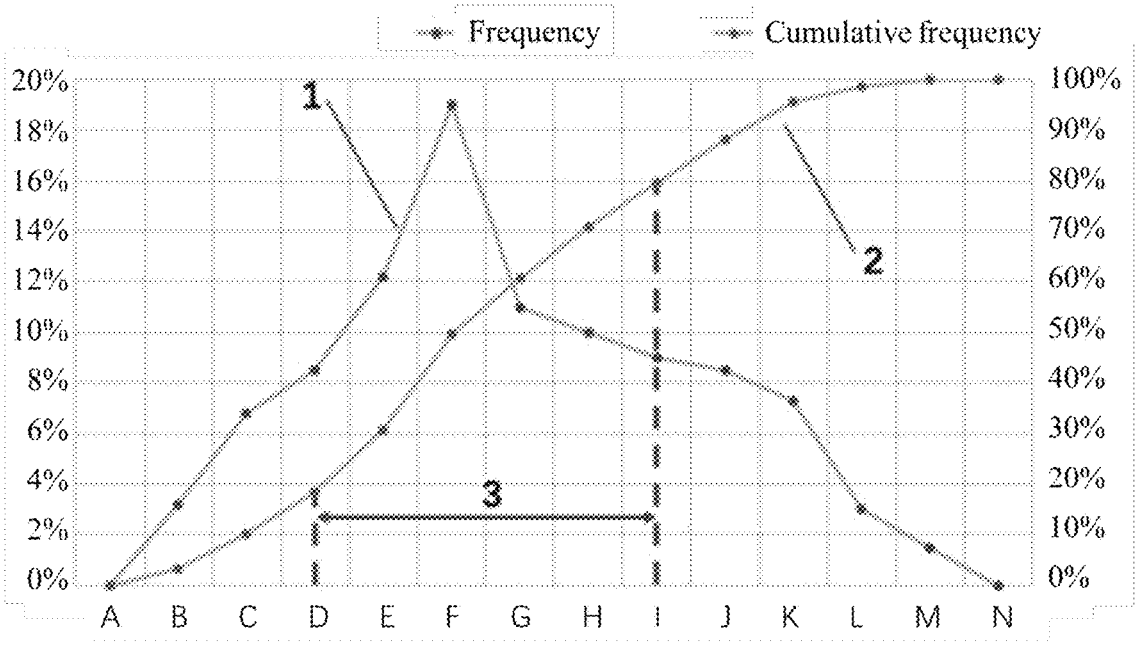
FIG. 1 is a schematic diagram of frequency analysis of reservoir water level in the present invention.

FIG. 1 is a schematic diagram of frequency analysis of reservoir water level. The vertical axis on the right side of the Figure (i.e. 0-100%) represents the frequency percentage, and the horizontal axis A-N represents the evenly distributed water level, with A-N distributed from high water level to low water level; Curve 1 is the reservoir water level frequency curve 1, which records the frequency of each water level; Curve 2 is the cumulative frequency curve of reservoir water level, which records the variation of cumulative frequency from low to high for each water level. Region 3 in FIG. 1 is the elevation range 3 of the restoration area of the drawdown zone. The frequency of water level occurrence in this region is relatively high, and the damage to the drawdown zone is also the greatest.

Figure 2:
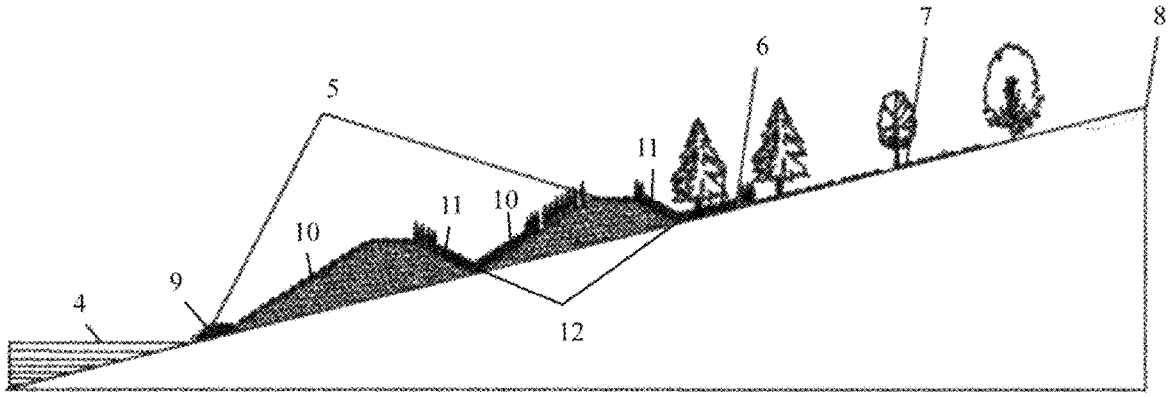
FIG. 2 is a schematic elevation diagram of a reservoir drawdown zone according to an embodiment of the present invention.

FIG. 2 is an elevation schematic diagram of a reservoir drawdown zone according to an embodiment of the present invention. As shown in FIG. 2, the reservoir drawdown zone is arranged on the slope of a river, lake, or reservoir, and the structure of the drawdown zone in this embodiment is arranged on the slope of the reservoir. The reservoir drawdown zone is arranged in sequence from top to bottom on the slope of the reservoir, including the low-frequency submergence area 8, a relatively-low-frequency submergence area 7, medium-frequency submergence area 6, relatively-high-frequency submergence area 5, and high-frequency submergence area 4. Due to the varying magnitude and frequency of water subsidence in each reservoir, in order to better address the issue of damage in the drawdown zone, it is necessary to divide the frequency areas based on the historical water level data in FIG. 1 and the frequency distribution of water levels. The specific analysis method is as follows:

1: Firstly, collect historical water level data of the reservoir, calculate the frequency of different elevations, and draw the water level frequency curve 1 of the reservoir;

2: Calculate the cumulative frequency of reservoir water level and draw the cumulative frequency curve 2 of reservoir water level. Extract the cumulative frequency of water level elevation in reservoirs at different frequencies, and divide the frequency areas based on the extracted water level elevations. Specifically, one partitioning method of this embodiment is to extract water level elevations with cumulative frequencies of 20%, 40%, 60%, and 80%, and then set the low-frequency submergence area 8 as the area with cumulative submergence frequency of 0% to 20% for the slope of the reservoir, the relatively-low-frequency submergence area 7 as the area with cumulative submergence frequency of 20% to 40% for the slope of the reservoir, the medium-frequency submergence area 6 as the area with cumulative submergence frequency of 40% to 60% for the slope of the reservoir, the relatively-high-frequency submergence area 5 as the area with cumulative submergence frequency of 60% to 80% for the slope of the reservoir, and the high-frequency submergence area 4 as the area with cumulative submergence frequency of 80% to 100% for the slope of the reservoir. Among them, the area with a cumulative submergence frequency of 20% to 80% is within the elevation range of 3 for the restoration of the drawdown zone. The present invention does not limit the division interval of cumulative submergence frequency, as long as the division of submerging frequency based on the cumulative frequency of reservoir water level falls within the scope of protection of the present invention.

Regarding the elevation range 3 of the restoration area for the drawdown zone, this area includes the relatively-high-frequency submergence area 5, the medium-frequency submergence area 6, and the relatively-low-frequency submergence area 7. Below are separate introductions to the aforementioned areas.

1. Relatively-High-Frequency Submergence Area

The relatively-high-frequency submergence area 5 is the area where a cumulative submergence frequency of the slope of the reservoir is set to 60% to 80%. The relatively-high-frequency submergence area 5 is located below the water level for a long time and needs to have the function of filtering pollutants in the water and improving water quality. Moreover, the water level frequency in this area is relatively high, which is prone to soil erosion. Therefore, the area mainly uses submerged plants for water purification, supplemented by soil stabilization plants.

A submerged bank is arranged in the relatively-high-frequency submergence area 5, and plants with filtering effect on water and plants that seal the soil and water need to be installed on the upstream slope 10 of the submerged bank. The bottom of the upstream slope 10 of the submerged bank is equipped with a submerged bank foot protection 9 composed of 50 cm to 80 cm diameter block stones, which better protects the structural safety of the submerged bank and prevents water flow erosion.

Figure 3:
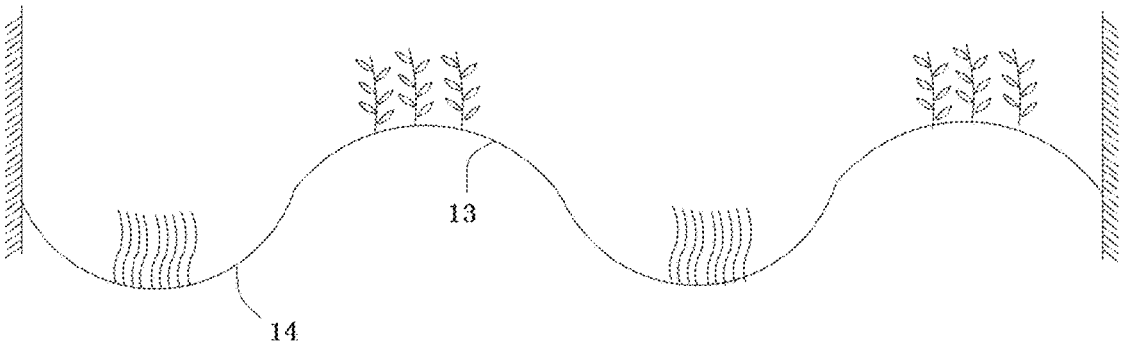
FIG. 3 is a structural diagram of the slope surface of a submerged bank facing the water in a reservoir drawdown zone according to an embodiment of the present invention.

As shown in FIG. 3, the upstream slope of the submerged bank is equipped with alternating convex structures 13 and concave structures 14. The convex structures 13 are planted with soil fixing plants, while the concave structures 14 are planted with submerged plants. In this embodiment, both the convex structure 13 and the concave structure 14 are longitudinally distributed on the slope of the upstream slope. The alternating convex structure 13 and concave structure 14 form a wave like surface, which can increase the impact resistance of the submerged bank. The convex structure 13 can disperse the impact force of water and increase the soil fixing ability of the convex structure 13 by planting soil fixing plants. The concave structure 14 can turn the impact force of water through the arc-shaped structure, and the evaporation of water can be reduced inside the concave structure. It has a water locking function, which can delay the time of water loss after the water level drops, further ensuring the water demand of submerged plants. Moreover, the concave structure 14 is easy to retain the tissues such as leaves and rods dropped by submerged plants, making it easy to recover pollutants in water.

The submerged plants play a crucial role in the absorption of nutrients in the soil and water. At the same time, different types of submerged plants have different abilities to resist pollution in the water. According to the order of their ability to resist pollution from strong to weak, the six communities of submerged plants are as follows: *Potamogeton malaianus*, Water caltrop (*Potamogeton crispus* L.), Hornwort (*Ceratophyllum demersum* L.), Foxtail algae, *Hydrilla verticillata* and Eel grass (*Vallisneria natans*). In this embodiment, alternating planting of Bermuda grass and *Potamogeton malaianuss* is carried out on the submerged bank in divided areas. The bermuda grass belong to low growing herbaceous plants with well-developed roots. The stems are thin and tough, and the lower part crawls on the ground for a long time. Unsteady roots often grow on the nodes, reaching a height of up to 30 centimeters. The stem wall is thick, smooth and hairless, and sometimes slightly flattened on both sides. The root and stem of the bermuda grass have strong spreading force and are widely spread on the ground, making them a good plant for reinforcing embankments and protecting soil. The tender seedlings of the e *Potamogeton malaianus* are planted at a rate of 30-40 plants per square meter. After planting, the broken leaves are removed from the water and replanted one month later based on the survival rate of the *Potamogeton malaianus*, in order to achieve the predetermined planting rate per square meter and achieve the expected water purification effect. Generally, 10% of the seedlings are replanted.

Due to the high requirement of soil moisture content for submerged plants, but the relatively-high-frequency submergence area 5 is not 100% submerged in water, which exists above the water level. In order to ensure the soil moisture content, a low-lying channel 12 is set up on the back surface of the submerged bank. When the water level of the reservoir drops, a portion of the water can be stored as a water source supply for the growth of aquatic plants when the water level is low. In the low-lying channel 12, both water purification plants and soil fixation plants are planted. In this embodiment, the water purification plant is *Potamogeton malaianus* and the soil fixation plant is Bermuda grass. In this embodiment, the slope ratio of the upstream slope of the submerged bank is 1:3-1:4, and the slope ratio of the downstream slope of the submerged bank is 1:2-1:3. This ratio can ensure that the water in the low-lying channel 12 meets the water demand of all the soil on the upstream slope 10 of the submerged bank, and meets the water content demand of submerged plants when the submerged bank is at the water level.

If the relatively-high-frequency submergence area 5 is too long, the area can be divided into multiple independent embankments, such as a first submerged bank and a second submerged bank. A low-lying channel 12 can be set between a first submerged bank and a second submerged bank to disperse the low-lying channel 12 and reduce its volume, preventing the problem of the overall stability of the revetment being reduced due to the large size of the low-lying channel 12. In addition, small low-lying channels 12 are easy to maintain and have low pollution. The plants on a first and second submerged banks can be adjusted, and the plants on both embankments do not need to be the same. For example, alternating planting of Bermuda grass and *Potamogeton malaianus* in different areas on a first submerged bank, and alternating planting of *Potamogeton malaianus* and *Calamus* in different areas on a second submerged bank. *Calamus* is a perennial herbaceous plant with a transverse, slightly flattened rhizome, branching, diameter of 5-10 millimeters, yellow brown outer skin, fragrant, and mostly fleshy roots, 5-6 centimeters long, with hair like fibrous roots. A second submerged bank is located at a high position in the relatively-high-frequency submergence areas, which is more likely to produce mosquitoes. *Calamus* not only has a soil fixing effect, but also has insect repellent properties. In this embodiment, alternating planting is carried out in areas on a first and second submerged banks to form a certain scale and avoid excessive fragmentation.

2. Medium-Frequency Submergence Area

The medium-frequency submergence area 6 is the area where the cumulative submerged frequency of the slope of the reservoir is set to 40% to 60%. Half of the time in the medium-frequency submergence area 6 is below the water level, and according to FIG. 1, the highest frequency water level is located in this area. Therefore, soil erosion is the most severe in this area, and soil stabilization is the main focus, supplemented by water purification. As this area is relatively close to the highest water level, trees are added to the plants in this area to greatly improve the soil stabilization effect.

In this embodiment, Zhongshan fir, Bermuda grass, and *Calamus* were planted on the medium-frequency submergence area 6. The Zhongshan fir has strong moisture tolerance and is sometimes submerged for 2-3 weeks without any adverse effects on the plants. On the other hand, water fir of the same specification may exhibit symptoms such as yellowing, root rot, and even death. Zhongshan fir can be soaked in water for a long time and its waterlogging resistance is similar to willow trees. The spacing between the planted Zhongshan fir plants is 2 m to 4 m, avoiding regular row planting and adopting a natural planting method. The spacing is naturally adjusted according to the site conditions. Bermuda grass 5-6 and *Calamus* 5-8 are planted throughout the medium-frequency submergence area 6, with plants in groups of three to five forming a patchy community distribution. Forest spots are left in the clustered Zhongshan fir plants. In the medium-frequency submergence area 6, trees are used as the soil stabilization core, and the details of soil stabilization are strengthened with Bermuda grass and other materials, with a combination of coarse and fine materials to maximize the soil stabilization effect in the area. In addition, *Calamus* is added to repel insects and improve the insect resistance of the area.

3. Relatively-Low-Frequency Submergence Area

The relatively-low-frequency submergence area 7 is the area where a cumulative submergence frequency of the slope of the reservoir is set to 20% to 40%. More than half of the relatively-low-frequency submergence area 7 is above the water level, and the time for water collection and inundation is relatively short. Only during some extreme periods will it be submerged. During this period, the water flow is relatively fast and large, and there is a lot of rainwater. Therefore, the area is mainly dominated by soil stabilization and trees, and multiple trees can be used for cross distribution to create mixed forests. This can fully utilize the space and nutrient area, enhance the ability to resist natural disasters, prevent wind and sand, improve site conditions, make full use of land and light resources to improve the quantity and quality of forest products, and achieve better protection. Maximizing economic benefits while also increasing species diversity, thereby improving the ecological stability of the region.

In this embodiment, Paper mulberry, *Pterocarya stenoptera*, Bermuda grass, *calamus* and Vetiver grass are planted on the relatively-low-frequency submergence area 7. The Paper mulberry is a deciduous tree with a height of 10-20 m. The root system of the Paper mulberry has the characteristics of fast growth, rapid germination, and strong tillering. The Paper mulberry can adapt to both the cold and dry climate in northern China and the warm and humid climate in southern China, with strong adaptability and fewer pests and diseases. The planting density varies according to the purpose of afforestation. Generally, the planting density is suitable with a plant spacing of 1.5 m, a row spacing of 2 m, and about 200 plants per mu. For the purpose of creating soil and water conservation forests and firewood forests, it is advisable to have 330-660 plants per mu.

The *Pterocarya stenoptera* is a large tree with a height of up to 30 meters and a diameter at breast height of 1 meter. It has lush branches and leaves, a wide crown width, and can form a thick and soft layer of dead branches and leaves on the ground when shedding leaves, which can conserve water sources. Its root system is well-developed, extremely water-resistant, and has strong adaptability. As a fast-growing afforestation tree species, *Populus euphratica* has a wide and deep root system, many lateral roots, thick canopy, strong canopy closure, and strong ability to intercept rainwater. It can be used as one of the excellent tree species for water side embankment protection, water source conservation, soil and water conservation, and wind prevention. In the study on the ability to restore eutrophic water bodies of four extremely water-resistant embankment protection tree species, it was shown that *Populus euphratica* has the strongest removal ability for TN (total nitrogen), and ranks third and second in TP (total phosphorus) and COD (chemical oxygen demand) removal ability, respectively. Therefore, *Populus euphratica* has strong purification ability for water bodies.

Vetiver grass system can penetrate hard red clay and weak areas between gravel and rock layers, and can grow up to 2-3 meters deep, with the deepest reaching 5-6 meters. At the same time, the number of root systems of Vetiver grass is large, forming a dense network in the soil, with a large contact area with the soil, strong adhesion, and good slope protection effect. Not only that, the tensile strength of the root system of Vetiver grass is high, reaching 40-120 megapascals, with an average of 75 megapascals, significantly higher than the tensile strength of various trees and shrubs such as Paper mulberry, poplar, willow and kumquat. Its root system can not only penetrate the soil layer for anchoring, but also effectively improve the shear strength of the soil, thereby stabilizing the slope.

In the relatively-low-frequency submergence area 7, the plant spacing for planting poplar and maple trees should be between 2 m and 4 m, avoiding regular row planting and adopting a natural planting method. The spacing should be adjusted naturally according to the site conditions. Bermuda grass, *Calamus* and vetiver should be planted throughout the relatively-low-frequency submergence area 7. Submerge plants in groups of three to five in the relatively-low-frequency submergence area 7, forming patchy community distribution, with forest spots left among the clustered trees.

The relatively-low-frequency submergence area 7 is mainly flooded with different types of trees, which not only improve the soil fixation effect but also increase the wind-break and sand fixation effect. Creating mixed forests can better play a protective role and enhance the ability to resist natural disasters. Combined with soil fixing plants such as Bermuda grass, the combination of coarse and fine can improve the soil fixation ability. Combined with plants with developed root systems such as vetiver grass, the soil fixation ability can be further improved. Then, by using *calamus* to improve the insect resistance in the area, the best soil fixation effect can be achieved in the area.

Excavate several ponds 15 in the top area of the relatively-low-frequency submergence area 7, which can serve as a germplasm resource library for vegetation restoration in the bank drawdown zone. Especially for aquatic plants used in the drawdown zone, they can be cultivated in this area for use in drawdown zone restoration. When the water level rises to this area, they can automatically store water in ponds 15, allowing aquatic plants to be cultivated in ponds 15 with the same water quality. Through drawdown zone restoration, pollutants flowing from the bank slope to the reservoir area and adsorbed nitrogen, phosphorus, and other substances in the water can be effectively intercepted; plants in the drawdown zone can play a good role in intercepting, absorbing, and degrading pollutants, and play a certain role in ensuring the safety of reservoir water quality.

Figure 4:
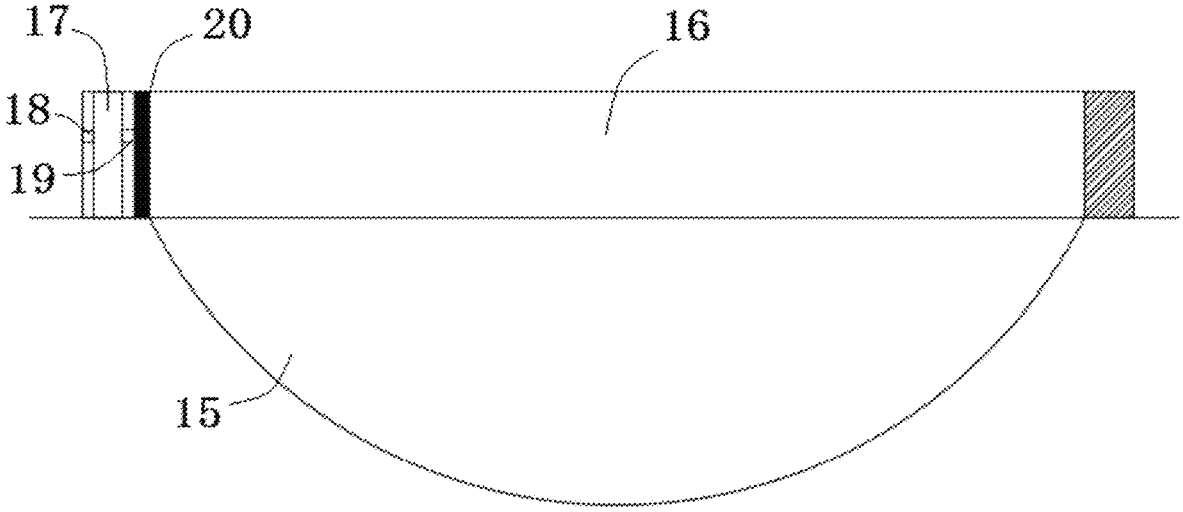
FIG. 4 is a structural diagram of a reservoir with a drawdown zone according to an embodiment of the present invention.

As shown in FIG. 4, there are water retaining walls 16 around the pond 15 that are higher than the relatively-low-frequency submergence area 7. The water retaining walls 16 are equipped with electrically controlled gates 17, and the outer side of the electrically controlled gates 17 is equipped with a first water level sensor 18. The inner side of the electrically controlled gates 17 is equipped with a second water level sensor 19, and the height of a first water level sensor 18 is the same as that of a second water level sensor 19. If the water level detected by a first water level sensor 18 is not detected by a second water level sensor 19, it means that the water level outside the water retaining wall 16 is higher than the water level inside the wall 16. Then, the electrically controlled gates 17 are controlled to open, allowing the rising water level to enter the pond 15 and replenish water for the pond 15; if a first water level sensor 18 does not detect the water level, it indicates that the water level outside the water retaining wall 16 is low, and the electric control gate 17 is closed. The inner side of the electrically controlled gate 17 is equipped with a block 20, which is used to intercept the outflow of plants from the pond 15 when the electrically controlled gate 17 is opened.

Although the present invention has been described in detail with general explanations and specific embodiments in the preceding text, some modifications or improvements can be made based on the present invention, which is obvious to those skilled in the art. Therefore, all modifications or improvements made without departing from the spirit of the present invention are within the scope of protection claimed by the present invention.

The invention claimed is:

1. A drawdown zone arranged on a slope of a river, lake or reservoir, wherein the drawdown zone includes: a low-frequency submergence area, a relatively-low-frequency submergence area, a medium-frequency submergence area, a relatively-high-frequency submergence area and a high-frequency submergence area arranged in sequence from top to bottom on the slope of the river, lake or reservoir and divided according to a cumulative submergence frequency distribution of the slope of the river, lake or reservoir obtained based on historical water level data;

a submerged bank is arranged in the relatively-high-frequency submergence area, and a slope surface of an upstream slope of the submerged bank is provided with alternating convex structures and concave structures wherein soil fixing plants are planted on the convex structures and submerged plants are planted on the inside of the concave structures;

a medium-frequency submergence area vegetation is planted in the medium-frequency submergence area; and a relatively-low-frequency submergence area vegetation is planted in the relatively-low-frequency submergence area.

2. The drawdown zone according to claim 1, wherein the low-frequency submergence area is an area where a cumulative submergence frequency of the slope of the river, lake or reservoir is 0% to 20%, the relatively-low-frequency submergence area is an area where a cumulative submergence frequency of the slope of the river, lake or reservoir is 20% to 40%, the medium-frequency submergence area is an area where a cumulative submergence frequency of the slope of the river, lake or reservoir is 40% to 60%, the relatively-high-frequency submergence area is an area where a cumulative submergence frequency of the slope of the river, lake or reservoir is 60% to 80%, and the high-frequency submergence area is an area where a cumulative submergence frequency of the slope of the river, lake or reservoir is 80% to 100%.

3. The drawdown zone according to claim 1, wherein a low-lying channel is arranged on a downstream slope of the submerged bank.

4. The drawdown zone according to claim 3, wherein a slope ratio of the upstream slope of the submerged bank is 1:3-1:4, and a slope ratio of the downstream slope of the submerged bank is 1:2-1:3.

5. The drawdown zone according to claim 3, wherein both water purification plants and soil fixing plants are planted in the low-lying channel.

6. The drawdown zone according to claim 5, wherein the water purification plants are *Potamogeton malaianus*, and the soil fixing plants are Bermuda grass.

7. The drawdown zone according to claim 1, wherein the submerged bank has a first submerged bank and a second submerged bank located at a higher position than the first submerged bank.

8. The drawdown zone according to claim 7, wherein Bermuda grass and *Potamogeton malaianus* are alternately planted in divided areas on the first submerged bank, and *Potamogeton malaianus* and *calamus* are alternately planted in divided areas on the second submerged bank.

9. The drawdown zone according to claim 7, wherein a submerged bank foot protection is provided at bottom of an upstream slope of the first submerged bank.

10. The drawdown zone according to claim 1, wherein the medium-frequency submergence area vegetation planted in the medium-frequency submergence area is Zhongshan fir, Bermuda grass and *Calamus* wherein the Bermuda grass and *Calamus* are planted throughout the medium-frequency submergence area.

11. The drawdown zone according to claim 1, wherein the relatively-low-frequency submergence area vegetation planted in the relatively-low-frequency submergence area is Paper mulberry, *Pterocarya stenoptera*, Bermuda grass,

*calamus* and vetiver grass, wherein the Bermuda grass, *calamus* and vetiver grass are planted throughout the relatively-low-frequency submergence area.

12. The drawdown zone according to claim 1, wherein several ponds are excavated in the relatively-low-frequency submergence area.

13. The drawdown zone according to claim 12, wherein water retaining walls higher than the relatively-low-frequency submergence area are provided around the pond, electric control gates are installed on the water retaining walls, an outer side of the electric control gates is equipped with a first water level sensor, and an inner side of the electric control gates is equipped with a second water level sensor.

14. The drawdown zone according to claim 1, wherein the drawdown zone is arranged on the slope of the reservoir.

15. The drawdown zone according to claim 1, wherein a submerged bank foot protection is provided at bottom of the upstream slope of the submerged bank.

* * * * *